US012130102B1

(12) United States Patent
Thornton

(10) Patent No.: US 12,130,102 B1
(45) Date of Patent: Oct. 29, 2024

(54) AIRBORNE WEAPON SYSTEM

(71) Applicant: MACH INDUSTRIES INC., Austin, TX (US)

(72) Inventor: Ethan Thornton, Boerne, TX (US)

( * ) Notice: Subject to any disclaimer, the term of this patent is extended or adjusted under 35 U.S.C. 154(b) by 84 days.

(21) Appl. No.: 18/295,691

(22) Filed: Apr. 4, 2023

Related U.S. Application Data

(60) Provisional application No. 63/330,135, filed on Apr. 12, 2022.

(51) Int. Cl.
*F41A 1/04* (2006.01)
*F41A 9/36* (2006.01)
*F41A 1/08* (2006.01)

(52) U.S. Cl.
CPC ..... *F41A 1/04* (2013.01); *F41A 9/36* (2013.01); *F41A 1/08* (2013.01)

(58) Field of Classification Search
CPC ..... F41A 9/35; F41A 9/36; F41A 1/04; F41A 1/08
USPC ..... 89/7
See application file for complete search history.

(56) References Cited

U.S. PATENT DOCUMENTS 2,965,000 A * 12/1960 Skinner ..... F41A 1/04 89/7
3,465,638 A 9/1969 Canning
3,503,300 A * 3/1970 Dardick ..... F41A 9/27 89/33.17
4,653,380 A 3/1987 Griffing
4,757,740 A * 7/1988 McFarland ..... F41A 1/04 89/7
5,078,117 A 1/1992 Cover
5,703,322 A 12/1997 Tidman
6,517,010 B1 2/2003 Barykin
7,254,914 B2 8/2007 Lund
7,665,396 B1 2/2010 Tippmann
9,404,718 B1 * 8/2016 Shaver ..... F41A 3/04
2004/0144012 A1 7/2004 Adams
2012/0216697 A1 * 8/2012 Jacobsen ..... F41B 9/0093 89/7

* cited by examiner

*Primary Examiner* — John Cooper
(74) *Attorney, Agent, or Firm* — Egbert, McDaniel & Swartz, PLLC

(57) ABSTRACT

A weapon system includes a rotatable part having a plurality of barrels arranged in an array, a drive motor connected to the rotatable part so as to drive the barrels in rotation, a static part positioned rearwardly of the rotatable part, a magazine positioned rearwardly of the static part, and an ammunition feed mechanism cooperative with projectiles in the magazine so as to move the projectiles from the magazine to a position adjacent to the end of the plurality of barrels. The static part has a plurality of combustion chambers communicating with the plurality of barrels and with the end of the plurality of barrels. The combustion chambers are adapted to ignite a gaseous fuel therein so as to drive a projectile outwardly through the barrels. A plurality of actuators are adapted to load the projectiles into the end of the plurality of barrels.

20 Claims, 5 Drawing Sheets

AIRBORNE WEAPON SYSTEM

RELATED U.S. APPLICATIONS

The present application claims priority to Provisional Application No. 63/327,012, filed on Apr. 4, 2022.

BACKGROUND OF THE INVENTION

1. Field of the Invention

The present invention relates to weapons. More particularly, the present invention relates to weapons that are adapted to be fired from an airborne platform. More particularly, the present invention relates to weapon systems whereby the projectiles are driven by an oxyhydrogen fuel source.

2. Description of Related Art Including Information Disclosed Under 37 CFR 1.97 And 37 CFR 1.98

The classic gun as shown by R. J. Gatling in U.S. Pat. No. 125,563, issued on Apr. 9, 1872, has all of its gun barrels and their respective gun bolts on longitudinal axes which are parallel to the longitudinal axes of the rotor, i.e. the axes form that form a cylinder. H. Otto in U.S. Pat. No. 2,872,847, issued on Feb. 10, 1959, proposed to skew the cylinder of the gun barrels to provide upon firing a force component in the direction of rotation so as to reduce the external power required to drive the gun. In the M61A1 Vulcan gun, the gun barrels are arranged in a truncated cone, with each gun barrel on a longitudinal axis which is at 0° 45' to the longitudinal axis of the rotor. A later development was the GAU-8 gun in which a smaller angle is used.

The GAU-8 gun is a thirty millimeter hydraulically-driven seven-barrel Gatling-style autocannon that is typically mounted in aircraft. This gun is designed to destroy a wide variety of ground targets. The GAU-8 gun delivers very powerful rounds at a high rate of fire. The GAU-8 gun is used in various ship weapon systems so as to provide defense against short-range threats, such as highly maneuverable missiles, aircraft, and fast-maneuvering surface vessels. The GAU-8 is currently produced by General Dynamics.

The GAU-8 weighs approximately 620 pounds. However, the complete weapon, with feed system and drum, weighs approximately 4000 pounds with a maximum ammunition load. It measures approximately nineteen feet, five and half inches from the muzzle to the rearmost point of the ammunition system. The ammunition drum is approximately 34.5 inches in diameter and 71.5 inches long. Power for operating the gun is provided by twin hydraulic motors pressurized from two independent hydraulic systems. The magazine can hold 1174 rounds. Muzzle velocity when firing armor-piercing incendiary rounds is approximately one thousand meters per second so as to give the gun a muzzle energy of just over two hundred kilojoules.

The standard ammunition mixture for anti-armor use of the GAU-8 gun is a five-to-one mix of PGU-14/B armor piercing incendiary with a projectile weight of approximately fourteen ounces. An innovation in the design of the GAW-8 ammunition is the use of aluminum alloy casings place of the traditional steel or brass. This added 30% to the ammunition capacity for a given weight.

The GAU-8 gun's rate of fire was originally selectable at 2100 rounds per minute in the low setting to 4200 rounds per minute in the high setting. At this speed, takes approximately eighteen seconds of sustained fire to empty the magazine. In practice, the canon is limited to one and two second bursts to avoid overheating and conserve ammunition. The GAU-8 ammunition feed is linkless so as to reduce weight and avoid a great deal of potential for jamming. The feed system is double-ended, allowing the spent casings to be returned to the ammunition drum. Additionally, returning empty casings to the drum has less effect on the aircraft's center of gravity than ejecting them.

Unfortunately, the GAU-8 gun has various drawbacks. First of all, since the ammunition incorporates its own explosive mixture, the ammunition is quite heavy. Furthermore, the barrels of the GAU-8 gun are separately loaded for firing. As such, during a single rotation of the array of barrels, each barrel will fire only a single bullet. There is a need for each of the barrels to fire separate bullets in order to speed the rate of bullet discharge. Furthermore, the area associated with the storage of spent casings can be very large within the aircraft. As such, need has developed so as to minimize the amount of weight following the firing of such weapon. The amount of ammunition that can be carried by the GAU-8 is limited by the size of the ammunition (including the explosive component). The GAU-8 also has a great deal of recoil. As such, it is desirable to minimize the amount of recoil so as to improve the stability of the aircraft carrying the GAU-8. The GAU-8 also has a large number of moving parts. This complicates the construction and manufacturing of the weapon and, at the same time, increases the chance for jamming or error.

Numerous devices and mechanisms have been devised for propelling a projectile toward a target. Firearms, for example, use the sudden release of pyrotechnic gases from a gunpowder or other pyrotechnic charge to propel a bullet. Due to government control and other restraints placed upon firearms, however, other means of providing a projectile propulsion force have been developed. Such non-pyrotechnic devices include devices for releasing compressed gas, such as $CO_2$, from a compressed or liquefied gas capsule to project a projectile.

Some compressed gas cartridge weapons are adapted to utilize a single compressed gas cartridge for providing the propellant force for a number of different projectiles. For example, U.S. Pat. No. 4,150,656 to Curran, discloses such a multi-shot weapon utilizing compressed gas released from a compressed gas capsule to provide the propellant force. However, multi-shot compressed gas devices suffer from a number of problems. One problem is that the devices require relatively large and heavy gas metering mechanisms for releasing only the desired quantity of propellant gas for each shot. The multi-shot compressed gas capsule itself is relatively large and heavy and requires a large housing. This increases the overall size of the weapon. Another problem with multi-shot compressed gas devices is leakage of compressed gas from the gas capsule. The gas capsules are commonly punctured to open a flow of compressed gas to the metering mechanism and pressure is often times lost due to an imperfect seal around the punctured opening. Furthermore, multi-shot devices generally require a propellant gas, such as $CO_2$, that liquefies at relatively low pressures in order to provide a sufficient number of shots per gas cartridge. Although large volumes of $CO_2$ may be stored in the liquid phase, weapons that use the liquefied gas must have a bulky gas expansion chamber to convert the stored liquid into a usable gas propellant.

Other weapons that use compressed gas from a compressed or liquefied gas capsule for providing ballistic propulsion force are adapted to expand the compressed material capsule in a single shot. For example, U.S. Pat. No. 2,725,048 to Koogle and U.S. Pat. No. 2,660,993 to Blakes-Lee are each directed to a single shot compressed or liquefied gas capsule-powered device. Both of these devices use a manually-actuated puncturing mechanism to puncture an opening in the compressed material capsule to release the compressed material and fire the weapon. Such manually-actuated capsule-puncturing mechanisms were large and bulky so as to increase the overall size of the weapon. Since the user supplied the capsule puncturing force, the thickness of the capsule walls, and thus the capsule pressure, is severely limited. Also, the prior single shot compressed or liquefied gas capsule devices provided only a small flow area for releasing gas to propel the projectile and thus make inefficient use of the available energy. Furthermore, the manually-operated mechanical-puncturing devices operate relatively slowly to release the compressed gas. This requires that the weapon be held on the target for a relatively long period of time.

In the past, various patents and patent application publications have issued with respect to weapons that use a compressed gas for the firing of a weapon.

U.S. Pat. No. 2,965,000, issued a Dec. 20, 1960 to L. A. Skinner, is an early patent in this field. This patent describes a liquid propellant, regenerative feed and a recoilless gun. The invention utilizes a thin-walled gun tube or barrel and employs liquid propellants of the hypergolic type for creating the operating pressures for discharging the projectiles from the gun barrel or tube and actuating the repeated firing or automatic operational cycles of the gun. The gun includes enlarged gas or combustion and pressure chambers at the inner end of the gun tube with gas exhaust conduits or tubes extending rearwardly from the pressure chamber and having restricted gas discharge nozzles at their rear ends for a counteracting recoil. A projectile feeding magazine is connected at its rear end to the combustion chamber by a pressure supply conduit for introducing pressure chamber pressure into the projectile feeding tube behind the projectile so as to feed them into the gun tube one at a time. A check valve is interposed in the connection. A pressure regulator is provided to control the maximum projectile feeding pressure.

U.S. Pat. No. 3,465,638, issued on Sep. 9, 1969 to T. N. Canning, describes a hyper-velocity gun. This hyper-velocity gun is an implosion-driven, light-gas gun. This gun comprises a launching tube that is made of a suitable ductile or yieldable material and is closed at one end thereof. A projectile is disposed within the launching tube and spaced from the closed end thereof. A light propellant gas is contained within the launching tube between the closed end thereof and the projectile to be propelled. A suitable high explosive charge surrounds the launching tube commencing at the closed end thereof and extending to the portion of the launching tube intermediate the location of the projectile. An initiator or detonator is disposed at the closed end of the launching tube to detonate the high explosive charge.

U.S. Pat. No. 4,653,380, issued on Mar. 31, 1987 to Griffing et al., teaches a bipropellant gun which utilizes an immiscible hydrocarbon fuel and oxidizer. These are combined in the gun's combustion chamber just prior to, or simultaneous with, ignition. The oxidizer has hydrogen peroxide having a concentration of less than 73% by weight. The oxidizer alone is bulk-loaded into the combustion chamber and a powdered solid hydrocarbon fuel is dispersed into the oxidizer by the function of a pyrotechnic igniter.

U.S. Pat. No. 5,078,117, issued on Jan. 7, 1982 to C. H. Cover, discloses a projectile propellant device adapted to supply compressed gas from a compressed gas container for providing a propulsion force for a projectile for providing the operating force for a gas-powered device. The propellant device includes a gas container containing a volume of gas at a sufficient pressure for applying a desired force upon release. A compressed gas releasing structure is provided for producing a release opening in the compressed gas container in response to the detonation of a pyrotechnic material. The release opening releases the compressed gas for applying the desired force to propel the projectile. The gas releasing structure includes a pyrotechnic charge device and a puncturing device both mounted within a suitable housing along with the gas container.

U.S. Pat. No. 5,703,322, issued on Dec. 30, 1997 to D. A. Tidman, discloses a cartridge having a high-pressure light gas. This cartridge accelerates a projectile and includes the light gas pressurized in a sealed container at between 5000 and 10,000 p.s.i. Upon ignition in the sealed container, a gas mixture having a low or intermediate molecular weight and a high or low energy density is applied as a high speed gas to accelerate the projectile to speeds above 2.4 km/sec.

U.S. Pat. No. 6,517,010, issued on Feb. 11, 2003 to Barykin et al., provides a system for igniting gas into a detonation projection gun. The system does not incorporate mechanical closing valves or systems for the supply of combustible gas. The supply of gas occurs directly and separately to the detonation chamber through a series of independent passages. One of the passages is for the comburant and another passage for the combustibles. Each passage is comprised of an expansion chamber and a plurality of distribution conduits having a reduced cross-section. The expansion chamber of each passage communicates directly with the corresponding supply line. The distribution conduits are distributed so that multiple gas injection points open out at the internal surface of the combustion chamber in order to produce a continuous and separate supply of gas at multiple points so as to ensure a direct and homogenous combustible mixing in the combustion chamber and with a flow which is sufficient to fill the chamber in each detonation cycle.

U.S. Pat. No. 7,254,914, issued on August 14,007 to Lund et al., teaches a hydrogen-operated recreational launcher. This hydrogen-operated gun shoots projectiles, such as paint pellets. Hydrogen gas is supplied to a combustion chamber and is combusted by a trigger-controlled piezoelectric igniter. The hydrogen may be supplied by a hydrogen generator or by a hydrogen storage container located in the gun housing. Suitable valve mechanisms are provided to control the flow of hydrogen to the combustion chamber and the expelling of exhaust gases from the combustion chamber.

U.S. Pat. No. 7,665,396, issued on Feb. 23, 2010 to T. J. Tippmann, provides a projectile launcher for paintballs. This apparatus includes a body defining a combustion chamber and a bore. A front bolt is provided that moves between a first position and a second position in which at least a portion of the front bolt is disposed within the combustion chamber in the first position. A rear bolt is movable between a third position and a fourth position such that the least a portion of the rear bolt is disposed within the combustion chamber in the fourth position. A drive mechanism is provided to urge the rear bolt to the fourth position. The apparatus includes an igniter device adapted to ignite a combustible mixture within the combustion chamber to propel the projectile through the bore.

U.S. Patent Application Publication No. 2004/0144012, published on Jul. 29, 2004 to J. S. Adams, shows an onboard combustion-gas-powered engine that supplies power to a paintball marker or other projectile launcher for generating gas pressure pulses for propelling paintballs and other projectiles. The combustion gas is produced by the engine can be allowed to rise in pressure within a confined volume of space before being released through a valve into a barrel for applying enhanced pressure pulses to the projectiles.

It is an object to the present invention to provide a weapon system that has greater energy density.

It is another object of the present invention to provide a weapon system that is less complex than the existing GAU-8 gun.

It is a further object of the present invention provide a weapon system that provides greater projectile velocity.

It is another object of the present invention provide a weapon system that utilizes less expensive ammunition.

It is another object of the present invention to provide a weapon system that simplifies military production and supply requirements.

It is another object of the present invention to provide a weapon system that offers the ability to vary power output from a common platform.

It is another object of the present invention to provide a weapon system that provides the ability to store more rounds of ammunition than existing weapon systems.

It is a further object to the present invention to provide a weapon system that offers increased power capabilities.

It is another object of the present invention to provide a weapon system that has greater reliability.

It is another object of the present invention to provide a weapon system that has less weight.

It is a further object of the present invention to provide a weapon system that has reduced operation cost.

It is a further object of the present invention provide a weapon system that offers the ability to manufacture propellants on-site.

It is a further object of the present invention provide a weapon system that has minimal recoil.

It is a further object of the present invention provide a weapon system that avoids any opening and closing of valves.

It is still another object of the present invention to provide a weapon system that has minimal moving parts.

These and other objects and advantages of the present invention will become apparent from a reading of the attached specification and appended claims.

BRIEF SUMMARY OF THE INVENTION

The present invention is a weapon system that comprises a rotatable part having a plurality of barrels arranged in an array, a drive motor connected to the rotatable part so as to drive the plurality of barrels in rotation, a static part positioned rearwardly of the rotatable part, a magazine positioned rearwardly of the static part, and an ammunition feed mechanism cooperative with projectiles in the magazine so as to move the projectiles from the magazine to a position adjacent to the end of the plurality of barrels. The plurality of barrels extend in parallel planar relationship to each other. Each of the plurality of barrels has an open end. The open ends are affixed to a plate. The plate has openings corresponding to the open ends of the plurality of barrels. The static part has a plurality of combustion chambers communicating with the plurality of barrels. The static part also has a plurality of actuators cooperative with the end of the plurality of barrels. The plurality of combustion chambers are adapted to ignite a gaseous fuel therein so as to drive a projectile outwardly through the barrels. The plurality of actuators are adapted to load the projectiles into the end of the plurality of barrels. The magazine has a gas tank and the plurality of projectiles therein. The gas tank communicates with the plurality of combustion chambers.

In the preferred embodiment of the present invention, the plurality of barrels comprise more than two barrels and preferably eight barrels. The plurality of barrels are in a rotatable array such that the end of the plurality of barrels faces one of the plurality of combustion chambers at the same time that another of the plurality of barrels faces one of the plurality of actuators. The plurality of combustion chambers is half that of the number of barrels. The plurality of actuators is equal to the number of combustion chambers. The actuators are arranged so as to alternate respectively between the combustion chambers.

The plate has an axle extending outwardly of therefrom on the side opposite the plurality of barrels. The axle is engaged with the drive motor such that the drive motor drives the axle so as to rotate the plate.

Each of the plurality of barrels has a barrel shroud surrounding the open end of the plurality of barrels at the plate. The barrel shroud is adapted to absorb the shock of ignition of the gas in the combustion chamber. The barrel shroud has a pressure equalizer extending therearound. A pressure equalizer has an O-ring with a hydraulic fluid therein or thereon. The hydraulic fluid is selectively pressurizable so as to absorb the shock of ignition.

The static part has a housing residing against the plate of the rotatable part. The housing has the plurality of combustion chambers affixed thereto. Each of the plurality of combustion chambers has an opening extending through the housing. The housing has a plurality of ammunition injection holes opening therethrough. Each of the plurality of ammunition injection holes has a diameter slightly less than a diameter of the projectile. The projectile is loaded by the actuator against the ammunition injection hole. The plate has an axle hole form centrally therethrough. The axle of the rotatable part extends through the axle hole so as to engage with the drive motor. The housing has a lip at a periphery thereof. This lip surrounds the periphery of the plate of the rotatable part.

The drive motor is an electric motor. The electric motor has a drive belt cooperative with the shaft extending from the electric motor. The drive belt is cooperative with the plurality of actuators so as to drive the plurality of actuators between an extended position and a retracted position. The extended position drives the projectile into the open end of the barrel. The retracted position allows the projectile to be loaded into an area between the end of the barrel and the end of the actuator by the ammunition feed mechanism. Each of the plurality of actuators is movable by the drive belt such that a one-half turn causes the actuator to move to the extended position and another one-half turn moves the actuator to the retracted position.

The magazine has the projectiles arranged in a helically-stacked array therein. The gas tank is positioned centrally of the helically-stacked array. The projectiles of the helically-stacked array are connected to each other by a line. This line is cooperative with the ammunition feed mechanism such that the ammunition feed mechanism pulls each of the plurality of projectiles into the loaded position. The ammunition feed mechanism is positioned at a periphery of the plate of the rotatable part.

The magazine has a plurality of feed lines extending outwardly therefrom. The plurality of feed lines are connected to the gas tank and are respectively connected to the plurality of combustion chambers such that the gas tank is fed continuously to the plurality of combustion chambers. The gas tank contains a pressurized oxyhydrogen gas therein. In a preferred embodiment of the present invention, the gas tank comprises a hydrogen tank and an oxygen tank arranged separately from each other in the magazine.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
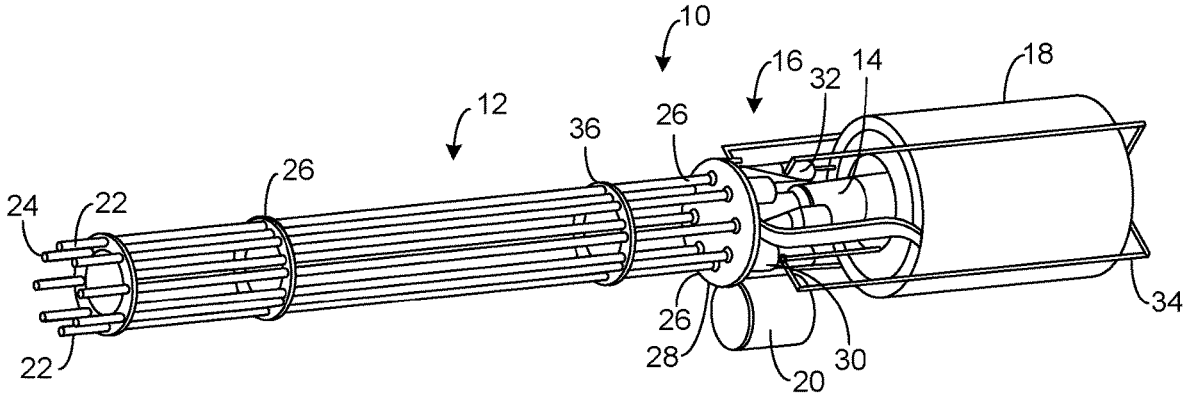
FIG. 1 is an upper perspective view of the weapon system in accordance with the teachings of the present invention.

Referring to FIG. 1, there is shown the weapon system 10 in accordance with the teachings of the present invention. The weapon system 10 includes a rotatable part 12, a drive motor 14, a static part 16, a magazine 18 and an ammunition feed mechanism 20. The rotatable part 12 has a plurality of barrels 22 arranged in an array. The plurality of barrels 22 extend in parallel planar relationship to each other. Each of the plurality of barrels 22 includes a muzzle 24 at an end away from the static part 16 and an open end 26 adjacent the static part 16. The open ends 26 are affixed to a plate 28. The plate 28 has openings corresponding to the open ends 26 of the plurality of barrels 22. The drive motor 14 is connected to the rotatable part 12 so as to drive the plurality of barrels 22 in rotation.

The static part 16 is positioned rearwardly of the rotatable part 12. The static part 14 has a plurality of combustion chambers 30 communicating with the plurality of barrels 22. The static part 16 also includes a plurality of actuators 32 that are cooperative with the end of the plurality of barrels 22. The plurality of combustion chambers 30 are adapted to ignite a gaseous fuel therein so as to drive a projectile outwardly of the muzzle 24 of the plurality of barrels 22. The plurality of actuators 32 are adapted to load the projectiles into the end 26 of the plurality of barrels 22.

The magazine 18 is positioned rearwardly of the static part 16. As will be described hereinafter, the magazine 18 has a gas tank and a plurality of projectiles stored therein. The gas tank is designed so as to communicate with the plurality of combustion chambers through the use of feed lines 34. The ammunition feed mechanism 20 is cooperative with the plurality of projectiles in the magazine 18 so as to move the projectiles from the magazine 18 to a position adjacent to the open ends 26 of the plurality of barrels 22.

As can be seen in FIG. 1, the plurality of barrels comprise eight barrels that are equally spaced from each other in a rotatable array. Supports 36 engage with the plurality of barrels 22 so as to support the array of barrels in a sturdy fashion. The plurality of barrels 22 will have the open ends 26 such that the open end 26 of the plurality of barrels 22 faces one of the plurality of combustion chambers 30 at the same time that another of the plurality of barrels 22 faces one of the plurality of actuators 32.

Figure 2:
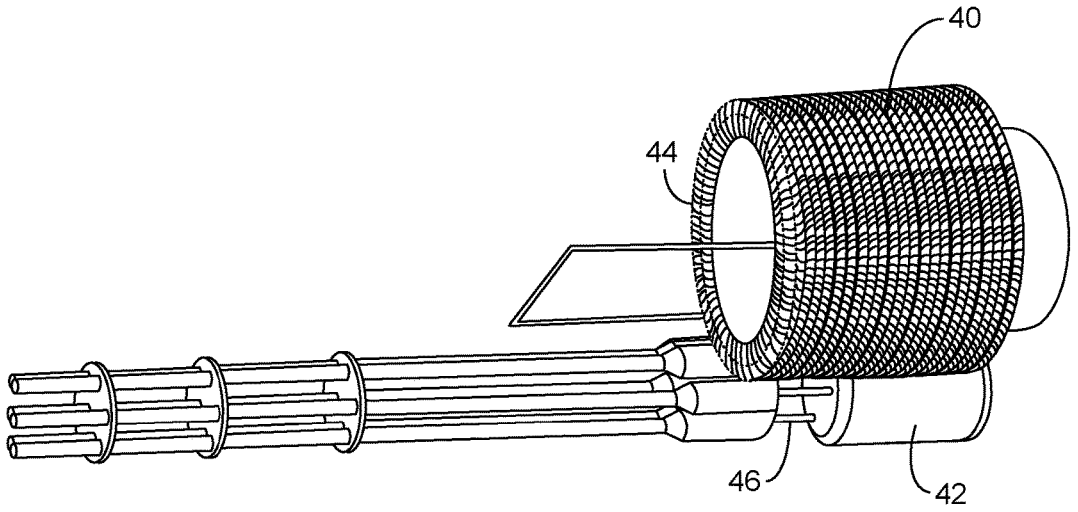
FIG. 2 is a partially exploded view showing the arrangement of projectiles and gas tank within the magazine of the weapon system of the present invention.

FIG. 2 shows the configuration on the interior of the magazine 18. In particular, the projectiles 40 arranged in a helically-stacked array within the interior of the magazine 18. The gas tank 42 is shown as positioned in the interior 44 of the helically-stacked array of projectiles 40. As will be described hereinafter, each of the projectiles of the helically-stacked array 40 are connected to each other by a line. FIG. 2 shows that struts 46 support the gas tank 42 and the magazine 18 relative to the static part 16 of the weapon system 10 of the present invention.

Figure 3:
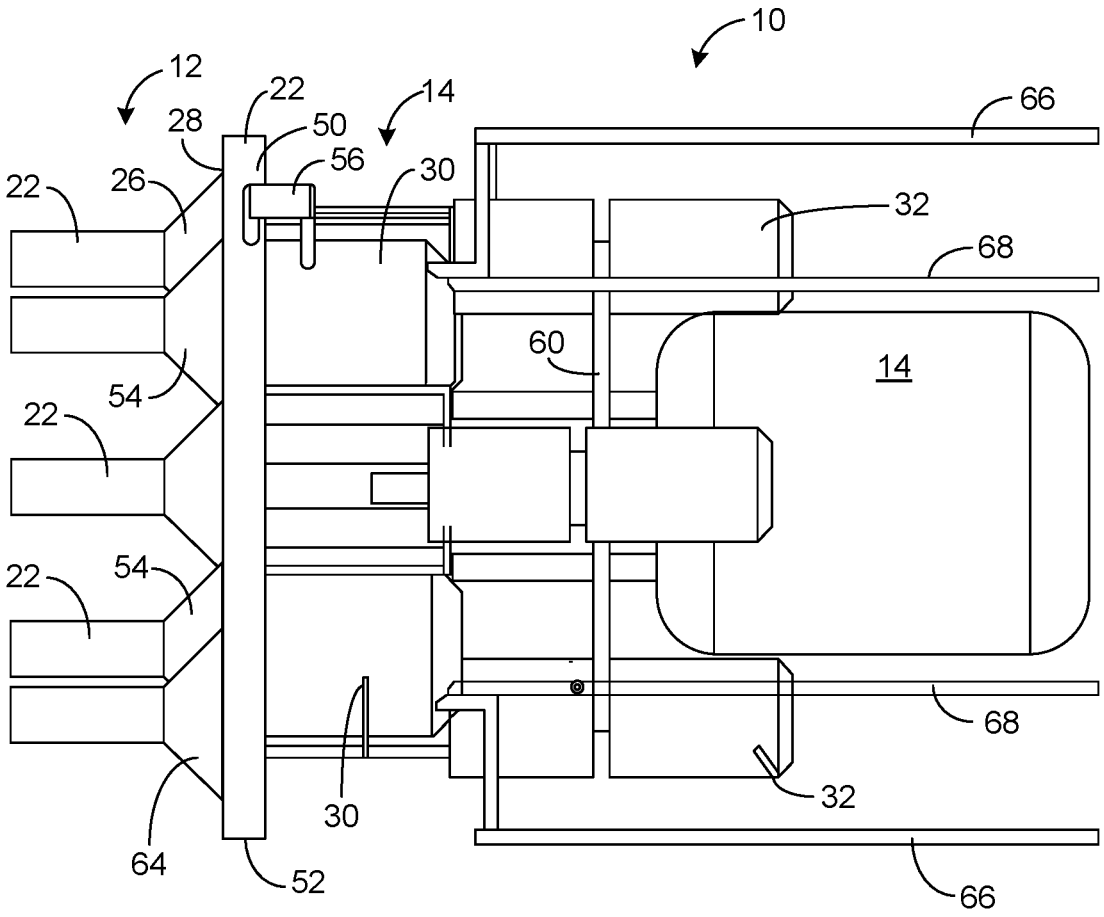
FIG. 3 is a side elevational view showing the relationship between the static part and the rotatable part of the weapon system of the present invention.

FIG. 3 shows a detailed view of the weapon system 10 and, in particular, the junction of the rotatable part 12 with the static part 14. In particular, the static part illustrates barrels 22 as having an open end 26 at a plate 28. Plate 28 is obscured by the housing 50 of the static part 14. The housing 50 includes a lip 52 that surrounds the periphery of the plate 28. As such, the plate 28 will be rotatable within the interior of the housing 50 and, in particular, within the interior of the rim 52 of housing 50. Each of the barrels 22 has a barrel shroud 54 extending therearound. Barrel shroud 54 is intended to absorb a shock of ignition of the gas within the combustion chambers 30. The barrel shroud 54 surrounds the open end 26 of the plurality of barrels 22 at the plate 28. The barrel shroud 54 will have a pressure equalizer 56 therein. This pressure equalizer 56 has an O-ring with hydraulic fluid therein or thereon. The hydraulic fluid can be selectively pressurizable so as to absorb the shock of ignition as desired. In particular, pressure equalizer 56 is illustrated as mounted to the housing 54 as shown as mounted to the housing 50 so as to be cooperative with the barrel shroud 54.

The static part 14 has housing 50 residing against the plate 28 of the rotatable part 12. The housing 50 has the plurality of combustion chambers 30 affixed thereto. Each of the plurality of combustion chambers 30 has an opening extending through the housing 50.

FIG. 3 further shows the drive motor 14. The drive motor 14 will have a shaft extending therefrom. The shaft can be connected to an axle associated with the rotatable part 12 (as will be described hereinafter). The plurality of actuators 32 comprise four actuators in which the four actuators are arranged so as to alternate respectively between the four combustion chambers 30. The drive motor 14 is, in the preferred embodiment of the present invention, an electric motor. This drive motor 14 has a drive belt 60 cooperative with the shaft of the drive motor 14. The drive belt 60 is cooperative with the plurality of actuators 32 so as to drive the plurality of actuators between an extended position and a retracted position. The extended position drives the projectile into the open end of the barrel 22. The retracted position allows the projectile to be loaded into an area between the end of the barrel 22 and the end of the actuator 32. Area 64 illustrates an area for the ammunition in-feed. The plurality of actuators 32 are configured so as to be movable by the drive belt 30 such that a one-half turn causes the actuators 32 to move to the extended position and another one-half turn moves the actuators 32 to the retracted position.

FIG. 3 shows that there are feed lines 66 and 68 that extend to the combustion chambers 30. Each the feed lines 66 and 68 are connected separately to an oxygen tank and a hydrogen tank. In the preferred embodiment of the present invention, the magazine 18 (as shown in FIG. 1) can incorporate separate oxygen and hydrogen tanks therein. The serves to reduce the weight of the gas fuel therein. Alternatively, the gas tank can be a single tank in which the hydrogen is separated by a diaphragm from the oxygen.

Figure 4:
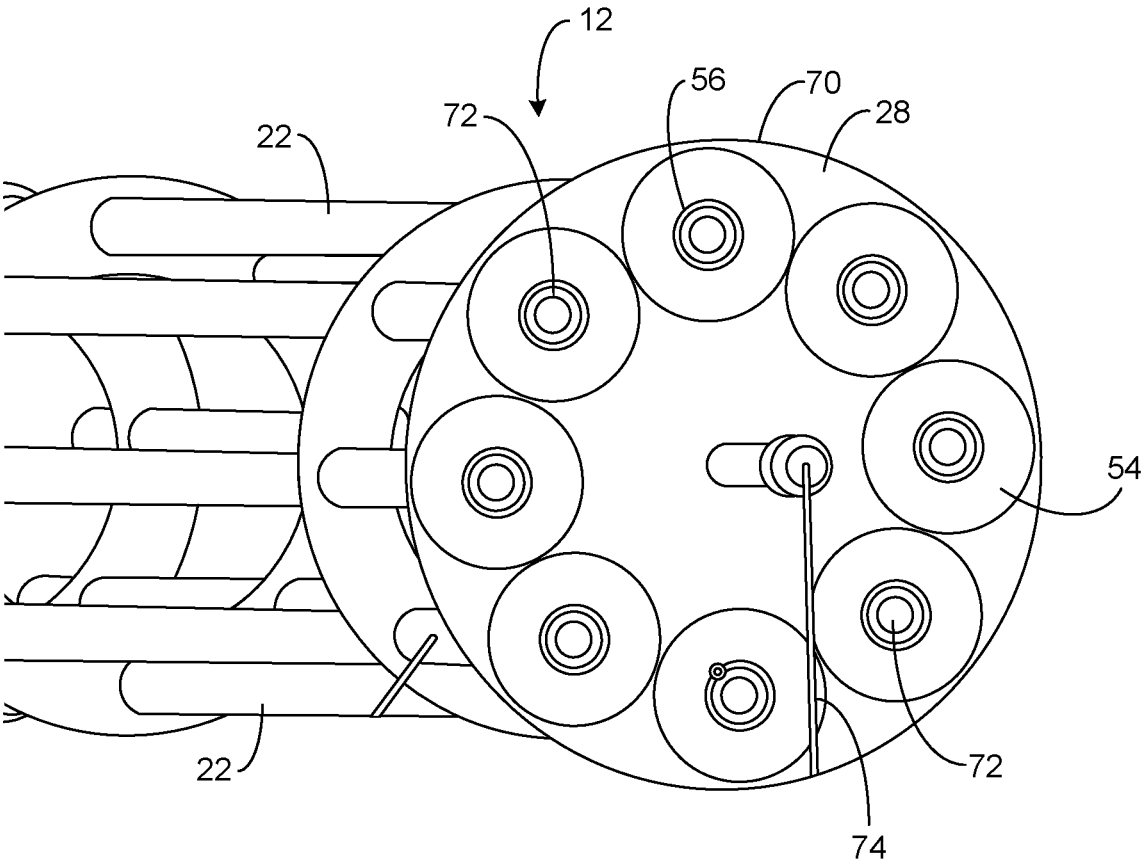
FIG. 4 is a lower perspective view of the configuration of the rotatable part of the present invention.

FIG. 4 shows an end view of the plate 28 associated with the rotatable part. Plate 28 has a generally circular configuration with an outer periphery 70. The outer periphery 70 will reside adjacent to the lip 52 of the housing 50 of the static part 14. There are a total eight barrel in-feed the holes 72 opening through the plate 28. Barrel shroud 54 extends around these barrel in-feed holes. Each of the barrel in-feed holes 72 will have a diameter that is slightly less than the outer diameter of the projectile that is placed into the loading position. Each of the barrel in-feed holes 72 will communicate with the respective barrels 22. FIG. 4 shows that each of the barrel in-feed holes 72 includes the pressure equalizer 56. It can be seen that pressure equalizer 56 is in the nature of an O-ring with a hydraulic fluid positioned thereon or therein. As such, the pressure within this O-ring can be adapted to counter the explosive forces within the combustion chambers in order to minimize the shock to the weapon system 10.

FIG. 4 shows that there is an axle 74 extending outwardly of plate 28. Axle 74 is engageable with the shaft of the drive motor 14. As such, the drive motor 14 can impart rotational movement to the rotatable part 14 by rotating the axle 74 and the attached plate 28.

Figure 5:
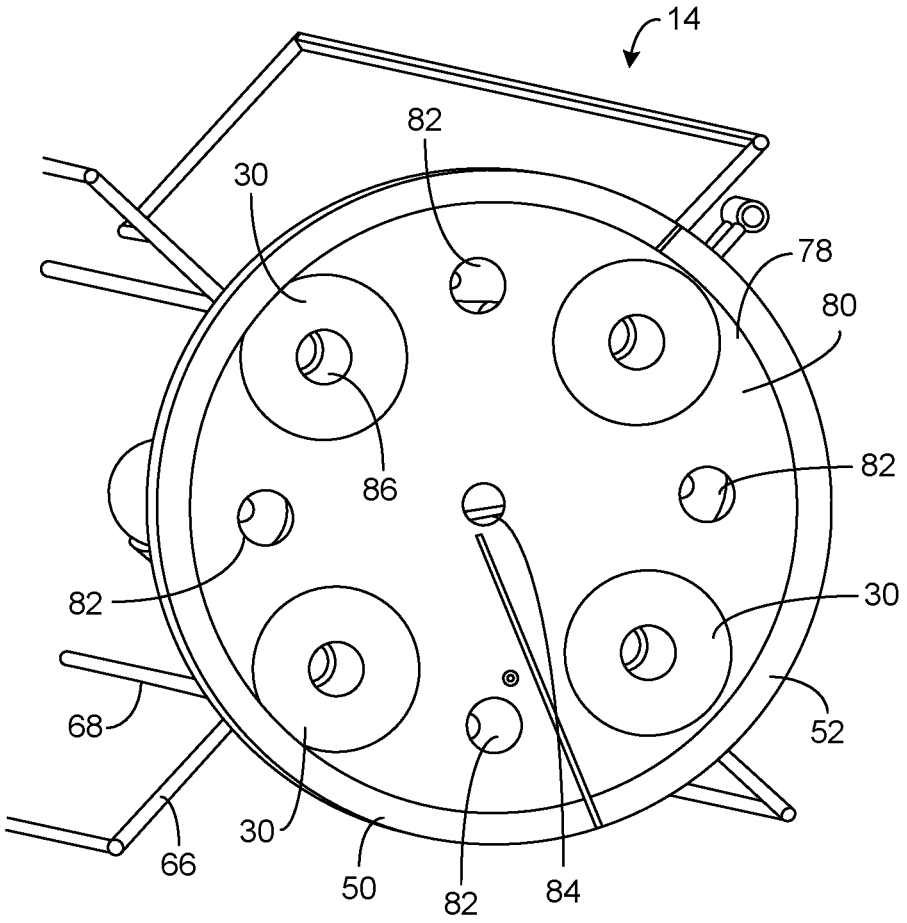
FIG. 5 is an end view showing the configuration of the housing associated with the static part of the present invention.

FIG. 5 illustrates the housing 50. Housing 50 includes lip 52 that has an inner diameter 78 that surrounds the periphery of the plate 28 of the rotatable part 12. The housing 50 includes a plate-like surface 80 having a plurality of ammunition injection holes 82 formed therethrough. Once again, ammunition injection holes 82 will have an inner diameter slightly less than the outer diameter of the ammunition. An axle hole 84 is formed centrally of the surface 80 of the housing 50.

FIG. 5 shows the array of combustion chambers 30. The combustion chambers 30 have an opening 86 that opens at the surface 80 of the housing 50. It can be seen that the ammunition injection holes 82 alternate relative to the combustion chambers 30. The axle 74 of the static part 12 will extend through the axle hole 84 so as to engage with the drive motor 14. As such, the static part 14 will remain stationary while the rotatable part 12 will rotate by the action of the drive motor 14 on the axle 74. Feed lines 66 and 68 extend to the combustion chambers 30 so as to supply the gaseous fuel for the combustion chambers 30. In the preferred embodiment of the present invention, this gaseous fuel is oxyhydrogen fuel. One of the feed line 66 will carry oxygen and the other feed line 68 will carry hydrogen. Oxyhydrogen fuel is important in the present invention since this can be manufactured in remote locations by simple electrolysis of water. As such, fuel will be available for use as the explosive force associated with a weapon system 10 of the present invention.

Figure 6:
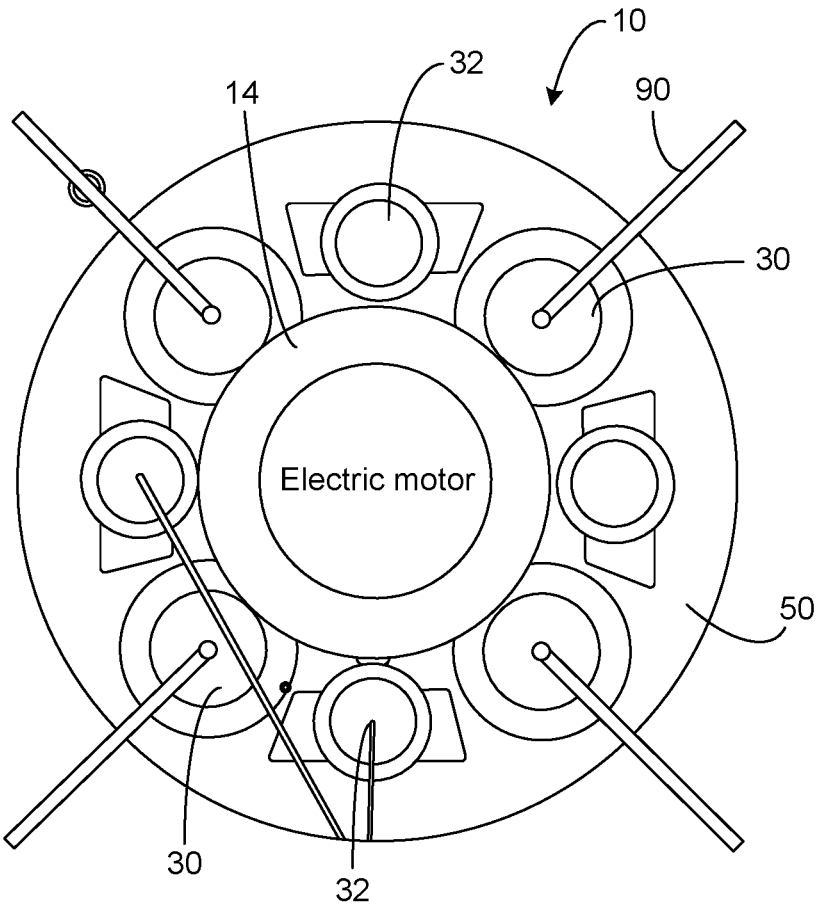
FIG. 6 is an end view of the weapon system of the present invention showing, in particular, the configuration of the electric motor, the actuators, and the combustion chambers.

FIG. 6 is an end view of the weapon system 10 of the present invention. In particular, FIG. 6 shows that the drive motor 14 is located centrally of the housing 50. The actuators 32 are illustrated as positioned between adjacent combustion chambers 30. Feed lines 90 extend each of the combustion chambers 30 so as to supply the oxyhydrogen fuel to each of the combustion chambers.

The operation of the present invention is quite unique. Initially, the ammunition feeding mechanism will "pull" on a line associated with the plurality of projectiles 40 in the magazine 18. This pulling action (in contrast to pushing systems used in the prior art) effectively draws each of the projectiles into a proper position adjacent to the ammunition injection holes 42. As such, the four ammunition injection holes 82 will have the projectiles respectively facing thereto. As the projectiles are placed in this position adjacent to the ammunition injection holes 82, the actuators 32 will be in the retracted position by action of the drive motor 14. Similarly, each of the combustion chambers 30 will be filled with the oxyhydrogen gas because of the pressurization in the gas tank 42. No valves are positioned between the gas tank 42 and the combustion chambers 30. As such, the combustion chambers 30 will continuously be filled with explosive gas. Spark plugs, or other ignition devices, can be associated with the combustion chambers so as to ignite the combustion. At the instant that the gas in the combustion chambers ignites, a complete propulsive force is exerted upon the projectile positioned adjacent to the ammunition injection hole 42 so that the projectile is launched outwardly of the muzzle 24 of the barrel 22.

When the projectile is positioned adjacent to the ammunition injection hole 82, it will be retained in place because the ammunition injection hole 82 has a diameter slightly less than the diameter of the projectile. When the actuator moves to its extended position, it will "extrude" the ammunition through the ammunition loading hole 72. Once the projectile is fully installed into the loading hole 72 of the rotatable part 12, it will be surrounded by the barrel and the barrel shroud. As the rotatable part 12 is rotated by the drive motor 14, the loaded barrel will move into a position adjacent to the opening of the combustion chamber 30. Once in this position, the combustion chamber can be ignited so as to exert the propulsive force to the projectile and thereby send the projectile through the barrel 22.

It is important to note that this is carried out in an extremely rapid, continuous and smooth manner. Loading of the open combustion chamber occurs continuously. The release of gas from the combustion chamber is blocked by surfaces of the plate 28 in the area between adjacent loading holes 72. It is only when the loading hole 72 aligns with the opening of the combustion chamber (and the gaseous mixture is ignited) that combustion occurs and gas is released. As the rotatable part 12 rotates and the plate 28 moves, the surfaces of the plate 28 will further block the opening of the combustion chamber so that gas from the gas tank 42 can load the combustion chamber (almost instantly) with fuel by way of the feed lines 66 and 68.

Similarly, the actuator 32 will exert a strong force onto the end of the projectile. When the loading hole 72 on the plate 28 rotates so as to match with the ammunition injection hole 82 of the housing 50, the actuator will force the bullet through the ammunition injection hole 82 and into the loading hole 72. This action occurs almost instantly and automatically because of the alignment with these holes. The bullet is prevented from exiting its position adjacent the end of ammunition injection hole 82 because of the surfaces of the plate 28. It is only when the holes align that the bullet is moved into this position. As such, the continuous spinning of the rotatable part 12 allows for the automatic loading and launching of projectiles through the barrels 22.

Importantly, unlike the GAU-8 weapon, the present invention actually can launch four projectiles per rotation of the rotatable part 12. As can be seen in FIGS. 4 and 5, there are four actuators and four combustion chambers. The four actuators alternate between the combustion chambers. As such, when the actuator causes the projectile to enter the loading hole 72, a rotatable part moves one-eighth of a turn so that the loaded projectile now faces the combustion chamber. The combustion chamber is then fired. The rotatable part will then moves one-eighth of a turn so that the barrel from which the projectile has been fired now faces the ammunition injection hole. Once again, another one-eighth turn causes the loaded projectile to face the open end of the combustion chamber for firing. As such, in a rapid-fire sequence, the present invention allows four times the number of projectiles to be released in a firing sequence.

The configuration the present invention provides greater reliability and faster firing. The present invention can put twice as much energy with the same amount of recoil. The GAU-8 has seven barrels as compared to the eight barrels of the present invention. The present invention offers the capability of 32,000 rounds firing from each barrel. The present invention does not have any opening or closing valves. The gas is constantly fed. Because of the oxyhydrogen fuel used for the firing of the combustion chambers, there are fewer moving parts. The present invention, by avoiding the charge associated with each bullet, reduces the weight of the ammunition. As such, the present invention can have more mass devoted to the gun rather than to the ammunition. The present invention reduces recoil in flight. Through the use of the barrel shrouds and the associated pressure equalizers, recoil is minimized. This also allows projectile velocities to be much greater. In other words, the present invention has increased velocity of the projectiles at the same energy as the GAU-8. The present invention produces less momentum and, thus, less recoil.

The present invention avoids the need for storage space for casings. No casings are required by the projectiles fired by the present invention. Since the present invention allows the ammunition to be stored in a helical stack, a greater amount of ammunition can be stored within the magazine of the present invention. The present invention is an entirely electric device that can operate off the electricity system of the flying or moving platforms. The present invention is a relatively simple construction. As such, the costs associated with the manufacture of the GAU-8 weapon are substantially reduced. The present invention does not require any casing release slots associated with the weapon nor any space required on the aircraft for the collection of such casings. As such, all hazards associated with the collection of casings are avoided by the present invention.

The use of oxyhydrogen fuel allows the fuel to be manufactured on-site through a simple electrolysis process. The amount of oxyhydrogen fuel introduced into each of the combustion chambers can be varied depending on the desired velocities to be achieved.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

I claim:

1. A weapon system comprising:

a rotatable part having a plurality of barrels arranged in an array, the plurality of barrels extending parallel planar relationship to each other, the plurality of barrels having an open end, the open end being affixed to a plate, the plate having an opening corresponding to the open end of the plurality of barrels;

a drive motor connected to said rotatable part so as to drive the plurality of barrels in rotation;

a static part positioned rearwardly of said rotatable part, said static part having a plurality of combustion chambers communicating with the plurality of barrels and a plurality of actuators cooperative with the end of the plurality of barrels, the plurality of combustion chambers being adapted to ignite a gaseous fuel therein so as to drive a projectile outwardly through the barrel, the plurality of actuators adapted to load the projectiles into the end of the plurality of barrels;

a magazine positioned rearwardly of said static part, said magazine having a gas tank and the projectiles therein, the gas tank communicating with the plurality of combustion chambers; and an ammunition feed mechanism cooperative with the projectiles in said magazine so as to move the projectiles from the magazine to a position adjacent the end of the plurality of barrels.

2. The weapon system of claim 1, the plurality of barrels comprising more than barrels.

3. The weapon system of claim 1, the plurality of barrels being in a rotatable array such that the end of the plurality of barrels faces one of the plurality of combustion chambers at the same time that another of the plurality of barrels faces one of the plurality of actuators.

4. The weapon system of claim 3, the plurality of combustion chambers being half the number of plurality of barrels, the plurality of actuators being equal to the number of the plurality of actuators and arranged so as to alternate respectively between the plurality of combustion chambers.

5. The weapon system of claim 1, the plate having an axle extending outwardly therefrom on a side opposite the plurality of barrels, the axle being engaged with said drive motor such that said drive motor drives the axle so as to rotate the plate.

6. The weapon system of claim 1, each of the plurality of barrels having a barrel shroud surrounding the open end of the plurality of barrels at the plate, the barrel shroud being adapted to absorb a shock of ignition of the gaseous fuel in the combustion chamber.

7. The weapon system of claim 6, the barrel shroud having a pressure equalizer extending therearound, the pressure equalizer having an O-ring with a hydraulic fluid therein or thereon, the hydraulic fluid being equal that in the combustion chamber and adapted to mitigate leaks and to absorb a force of ignition.

8. The weapon system of claim 1, said static part having a housing residing adjacent to the plate of said rotatable part, the housing having the plurality of combustion chambers affixed thereto, each of the plurality of combustion chambers having an opening extending through the housing.

9. The weapon system of claim 8, the housing having a plurality of ammunition injection holes opening therethrough, each of the plurality of ammunition injection holes having a diameter slightly less than a diameter of the projectile, the projectile being loaded by the actuator against the ammunition injection hole.

10. The weapon system of claim 9, the plate having an axle hole formed centrally thereof, the axle of said rotatable part extending through the axle hole so as to engage with said drive motor.

11. The weapon system of claim 8, said housing having a lip at a periphery thereof, the lip surrounding the periphery of the plate of said rotatable part.

12. The weapon system of claim 1, said drive motor being an electric motor, the electric motor having a drive belt cooperative with a shaft extending from the electric motor.

13. The weapon system of claim 12, the drive belt being cooperative with the plurality of actuators so as to drive the plurality of actuators between an extended position and a retracted position, the extended position driving the projectile into the open end of the barrel, the retracted position allowing the projectile to be loaded into an area between the end of the barrel and an end of the actuator.

14. The weapon system of claim 13, each of the plurality of actuators being movable by the drive belt such that a one-half turn causes the actuator to move to the extended position and another one-half turn moves the actuator to the retracted position.

15. The weapon system of claim 1, said magazine having the projectiles arranged in a helically-stacked array therein, the gas tank positioned centrally of the helically-stacked array.

16. The weapon system of claim 15, wherein the projectiles of the helically-stacked array are connected to each other by a line, the line being cooperative with said ammunition feed mechanism such that said ammunition feed mechanism pulls each of the plurality of projectiles into the loaded position.

17. The weapon system of claim 16, wherein the ammunition feed mechanism is positioned at a periphery of the plate of said rotatable part.

18. The weapon system of claim 1, said magazine having a plurality of feed lines extending outwardly therefrom, the plurality of feed lines being respectively connected to the plurality of combustion chambers such that the gaseous fuel from the gas tank is fed continuously to the plurality of combustion chambers.

19. The weapon system of claim 1, the gas tank having a pressurized oxyhydrogen gas therein.

20. The weapon system of claim 19, the gas tank comprising a hydrogen tank and an oxygen tank arranged separately from each other in the magazine in said magazine.

* * * * *